United States Patent [19]

Harris, Jr.

[11] Patent Number: 4,589,560

[45] Date of Patent: May 20, 1986

[54] BOTTLE AND CRATE FOR CONTAINING LIQUIDS

[75] Inventor: Robert M. Harris, Jr., Reseda, Calif.

[73] Assignee: McKesson Corporation, San Francisco, Calif.

[21] Appl. No.: 654,753

[22] Filed: Sep. 25, 1984

[51] Int. Cl.[4] ..... B65D 23/00

[52] U.S. Cl. ..... 215/1 C; 215/12 R; 215/10; 217/52

[58] Field of Search ..... 215/1 C, 10, 12 R; 220/69, 410; 217/52

[56] References Cited

U.S. PATENT DOCUMENTS

| | | | |
|---|---|---|---|
| 1,945,797 | 2/1934 | Bach et al. | 217/52 |
| 2,452,195 | 10/1948 | Johnson | 215/12 R |
| 2,915,640 | 12/1959 | Grubel et al. | 220/410 |
| 3,100,576 | 8/1963 | Frank | 215/1 C |
| 3,256,441 | 6/1966 | Grasty | 220/410 |
| 3,275,180 | 9/1966 | Optner et al. | 220/410 |
| 3,325,030 | 6/1967 | Rausing et al. | 215/1 C |
| 3,391,824 | 7/1968 | Wiseman | 215/10 |
| 3,482,759 | 12/1969 | Ortiz | 217/52 |
| 3,583,590 | 6/1971 | Ferraro | 215/10 |
| 3,655,113 | 4/1972 | Carroll | 217/52 |
| 3,802,595 | 4/1974 | Frahm et al. | 220/72 |
| 3,889,834 | 6/1975 | Harris, Jr. | 215/10 |

*Primary Examiner*—Joseph Man-Fu Moy
*Assistant Examiner*—David Fidei
*Attorney, Agent, or Firm*—Flehr, Hohbach, Test, Albritton & Herbert

[57] ABSTRACT

A bottle of molded plastic material which has a square main portion and a lower extension portion. The lower portion has corners of special configuration that cooperate with corner structures of a carrying crate or rack whereby the bottle is protected against injury.

2 Claims, 6 Drawing Figures

BOTTLE AND CRATE FOR CONTAINING LIQUIDS

This invention relates generally to the construction of a bottle suitable for containing water or other liquids. It is particularly applicable to the construction of bottles for containing drinking water and which are used in conjunction with water dispensing units, and carrying crates or racks.

BACKGROUND OF THE INVENTION

Bottles which are employed in the servicing of drinking water dispensing units are customarily cylindrical in form. Such bottles, when applied to units of the electrical or non-electrical type, are inverted and positioned upon the upper portion of the unit to supply water to an inner reservoir as it is being dispensed. Such non-electrical units are known as being of the olla type. The capacity of a typical bottle is of the order of five gallons. Some of the bottles are made of glass, and others are made of molded plastic. During transportation to and from dispensing units being serviced, the bottles are usually disposed within individual carrying crates, or racks which accommodate a plurality of bottles. A typical single carrying crate is square in horizontal section with structures disposed in the lower to upper inner corners that are dimensioned to strengthen the crate and to center the bottle, and protect it against injury. The bottle accommodating cells of a rack may be similarly constructed. A desirable objective, recognized by applicant, is to provide a bottle which has increased capacity, and which at the same time can be utilized with carrying crates and racks of the type described above.

An object of the invention is to provide a bottle construction which can be used in servicing of drinking water units, which have relatively high volumetric capacity, and which can be used in conjunction with carrying crates and racks of the above described construction.

Another object is to provide a bottle which has a lower portion of unique construction, which makes for increased volumetric capacity while at the same time serving to cooperate with a carrying crate or rack to protect the bottle against injury.

SUMMARY OF THE INVENTION

In general the invention consists of a bottle preferably constructed of molded plastic material, which has a main body portion formed of substantially flat side walls joined at right angles to each other, and also a lower portion which increases the volumetric capacity of the bottle, and which has corners of a special configuration that cooperate with corner structures of a carrying crate or rack. The lower portion has corners of a special configuration which cooperate with corner constructions of a crate or rack.

Further objects and features of the invention will appear from the following description in which the preferred embodiment is shown in detail in conjunction with the accompanying drawing.

Referring to the drawing.

DESCRIPTION OF THE PREFERRED EMBODIMENT

Figure 1:
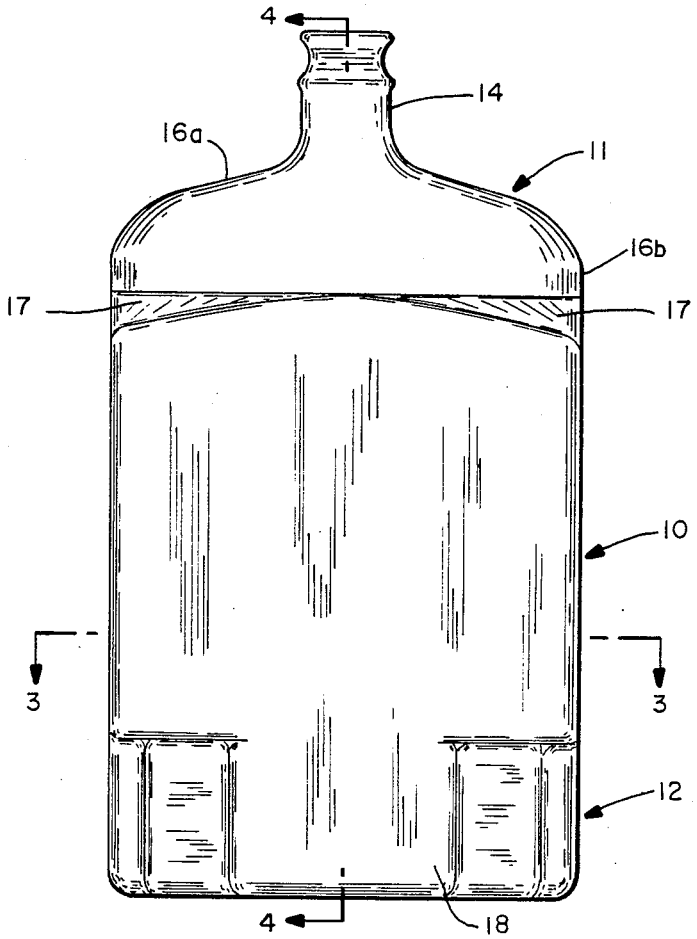
FIG. 1 is a side elevational view showing a bottle incorporating the present invention.
Figure 2:
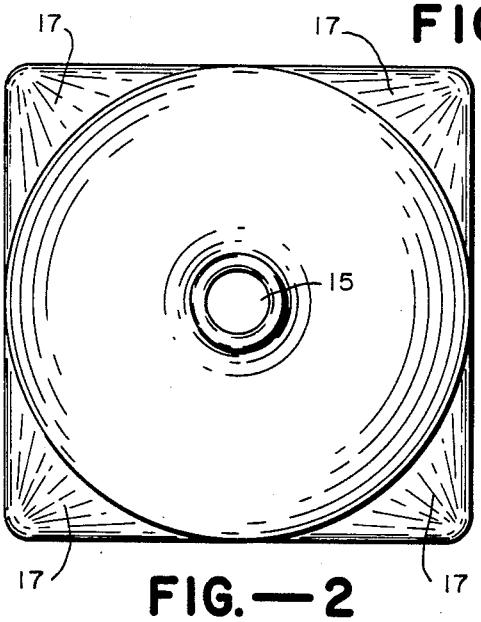
FIG. 2 is a plan view looking toward the upper end of FIG. 1.
Figure 3:
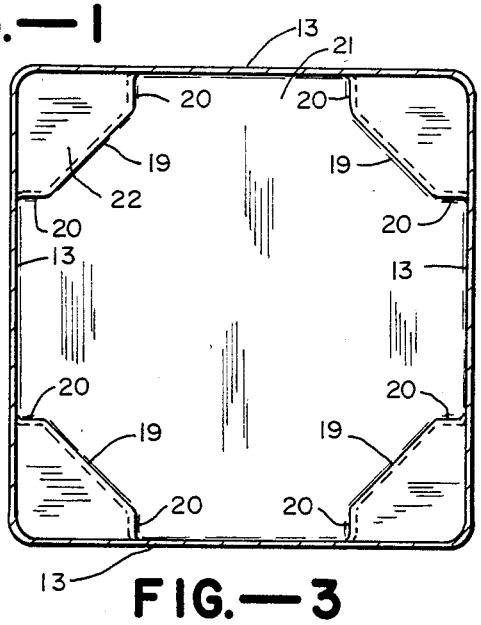
FIG. 3 is a cross-sectional view taken along the line 3—3 of FIG. 1.

The upright bottle as illustrated in FIGS. 1–3 consists of a main body portion 10, an upper portion 11 and a lower portion 12. Assuming that the bottle is in vertical position as shown in FIG. 1, the main portion 10 consists of side walls 13 that are planar and disposed at right angles to each other as shown in FIG. 3. In other words in horizontal cross section the main body portion is square or octagonal in configuration. The upper portion 11 consists of a neck 14 which has an access opening 15, sloped walls **16*a* which extend radially from the neck, and the downwardly extending wall 16*b*. Wall 16*b*, as viewed in FIG. 2, is circular in configuration. The corner portions 17 as viewed in FIG. 2, are arched walls which are integrally joined to the upper edges of the adjacent side walls 13 of the main body portion, and also to the lower edges of the portion 16*b***.

The lower portion 12 of the bottle is constructed as follows. The side walls 13 have lower depending extensions 18. At each corner of the bottle there is a vertical wall 19 (FIG. 3), each wall having its edges joined to the adjacent side walls 13. Preferably the margins 20 of each wall 19 are disposed at right angles to the adjacent side walls 13, as shown in FIG. 3, and the margins are joined to the side walls. The flat bottom wall 21 has its perimeter edges integrally joined to the lower edges of the side wall extension 18, and to the lower edges of the walls 19 and the margins 20. Also horizontal walls 22, located at each corner, have their edges joined to the upper edges of the walls 19, and to the adjacent lower edges of the side walls at the corners of the body, as illustrated in FIGS. 1 and 3.

The construction described above may be made with all of the walls and portions integral in a single molding operation.

Figure 5:
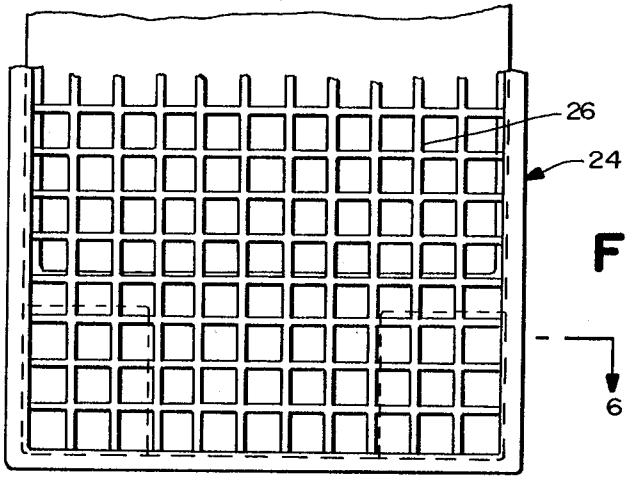
FIG. 5 is a side elevational view showing the lower and side portion of a carrying crate with which the bottle may be used.
Figure 6:
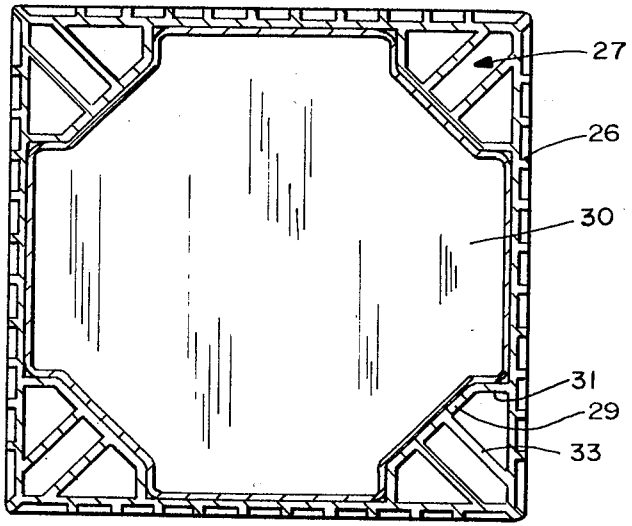
FIG. 6 is a cross-sectional view taken along the line 6—6 of FIG. 5, showing a portion of the bottle disposed within the crate.
Figure 4:
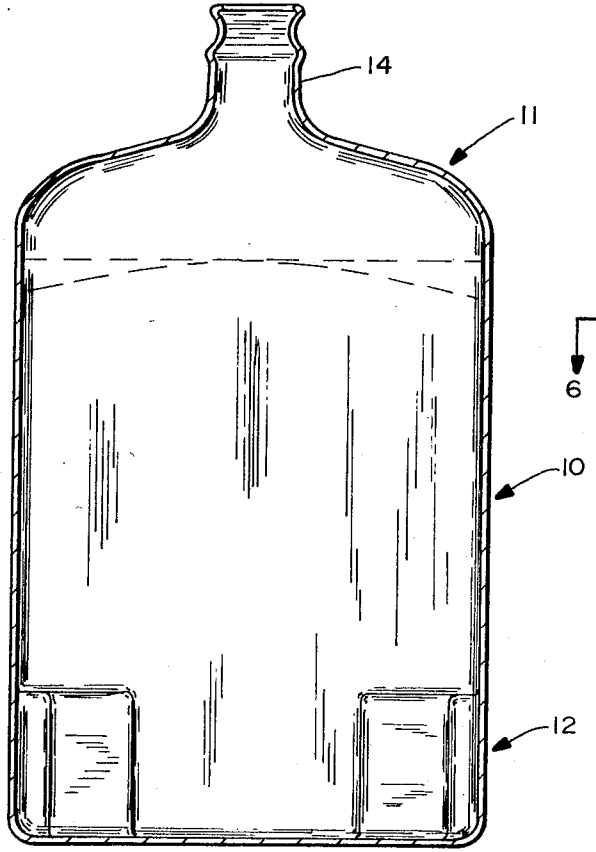
FIG. 4 is a cross-sectional view taken along the line 4—4 of FIG. 1.

FIGS. 5 and 6 illustrate a part of a conventional carrying crate 24 with which the bottle may be used. Lower portion 24 of the crate as illustrated consists of side walls 26 joined at their edges at right angles to each other, and a structure 27 located in each lower inner corner. As illustrated, each structure consists of a vertical wall 29 which is secured to and extends upwardly from the bottom wall 30 of the crate. Each wall 29 has margins 31 joined to and extending at right angles to the adjacent side walls. Also each wall 29 is reinforced by vertical webs 33. The height of the structures 27 may vary somewhat. In a typical instance the height may be about one fourth the height of the crate.

FIG. 5 shows the lower part of a bottle being inserted in the crate. FIG. 6 illustrates the lower portion of a bottle seated within the crate. The dimensions of the bottle, in particular the lower portion of the bottle, are such that the walls 18 of the bottle are in close proximity with the walls 29 of the crate. Thus, the lower portion of the bottle is retained against side movement in any direction, or rotation of the bottle relative to the crate. Thus the bottle is protected against injury during transportation and usage. In addition to effective protection of the bottle by the manner in which the lower portion is seated in the crate, the squared portions provide an effective increase in the volumetric capacity of the bottle. For example, a cylindrical bottle which normally would be used with a carrying crate of the type described, may have a volumetric capacity of the order of five gallons. With the construction of the present invention, the volumetric capacity may be increased by 20 percent. Because of the configuration of the upper portion 11 of the bottle, it can be used in standard drinking water dispensing units, the same as conventional cylindrical bottles.

It will be noted that the diagonal distance between walls 19 is such that when seated within a crate as shown in FIG. 6, these walls are parallel to and in proximity to the walls 29 of the crate. Thus any thrust that urges these walls together is taken by a relatively large area of contact. In contrast, when a cylindrical bottle is seated within the crate, any thrust urging the bottle against a wall 29 is taken over a relatively narrow area.

What is claimed is:

1. A bottle for containing liquids in combination with a carrying crate or rack that is square in horizontal section and having bottle engaging structures in its four lower corners, each of said structures comprising a vertical planar wall extending at an angle of 135° to the adjacent side walls of the crate, the bottle comprising, when disposed in vertical position within the crate:

(a) a main body portion having vertical side walls joined on four vertical corners and substantially square in horizontal section;

(b) an upper body portion comprising a neck having an access opening and walls extending radially from the neck and sloped downwardly to the upper edges of the side walls;

(c) a lower body portion forming a portion of the total volumetric capacity of the bottle, said body portion comprising:

1. depending extensions of the side walls, each extension having a horizontal width less than the width of the corresponding side wall of the bottle;
2. vertical lower planar cornerwalls each extending substantially at an angle of 135° to the corresponding side wall extensions, each corner wall having its vertical edges joined to the adjacent vertical edges of adjacent side wall extensions;
3. substantially horizontal planar corner walls at each lower corner of the main body portion having edges joined to the lower corner portions of the side walls of the main body, and also joined to the upper edges of said vertical planar corner walls;
4. a horizontal planar bottom wall having its peripheral edges joined to the lower edges of the depending side wall extensions and the corresponding lower edges of the side walls;

(d) the construction and dimensions being such that the volumetric capacity of the bottle includes the space provided by the main and upper portions and also by the lower portion of the body bounded by the lower side wall extensions and said corner walls, so that when the bottle is disposed within the crate or rack, the corner structures of the crate interfit within the lower corners of the bottle with said vertical walls of the corner structures being parallel to and in close proximity with said vertical walls of the bottle and with said horizontal planar corner walls of the bottle being in proximity with said bottle engaging structures of the crate.

2. A bottle as in claim 1 in which the vertical walls of each corner structure of the crate have vertical side margins extending at right angles to and secured to the adjacent side walls of the crate, and in which the said vertical corner walls of the bottle each have vertical side margins extending at right angles to the adjacent side wall extensions and secured thereto, whereby when the bottle is seated within the crate the vertical walls and margins thereof of the corner structures of the crate interfit the said vertical corner walls and margins thereof of the lower corners of the bottle to restrain the bottle against rotation or sidewise movement relative to the crate.

* * * * *